United States Patent [19]

Hsieh

[11] 4,357,028

[45] Nov. 2, 1982

[54] ROLLER SKATE WITH IMPROVED SOLE PLATE

[75] Inventor: Even Hsieh, Taipei, Taiwan

[73] Assignee: Chicago Roller Skate Company, Chicago, Ill.

[21] Appl. No.: 152,123

[22] Filed: May 21, 1980

[51] Int. Cl.[3] ..... A63C 17/02

[52] U.S. Cl. ..... 280/11.28; 36/115

[58] Field of Search ..... 280/11.28, 11.19, 11.27, 280/11.1 R, 11.23; 36/115; 411/116, 117, 119, 83

[56] References Cited

U.S. PATENT DOCUMENTS

| | | | |
|---|---|---|---|
| 2,424,783 | 7/1947 | Ware, Jr. | 280/11.19 |
| 2,664,295 | 12/1953 | Van Horn | 280/11.28 |
| 3,332,182 | 7/1967 | Mark | 411/116 |
| 3,478,802 | 11/1969 | Poccard | 411/116 |
| 4,058,323 | 11/1977 | Ware, Jr. | 280/11.28 |
| 4,146,241 | 3/1979 | Stevenson | 280/11.28 |
| 4,150,499 | 4/1979 | Wang | 36/115 |

*Primary Examiner*—Joseph F. Peters, Jr.

*Assistant Examiner*—Ross A. Weaver

*Attorney, Agent, or Firm*—Trexler, Bushnell & Wolters, Ltd.

[57] ABSTRACT

There is disclosed an improved roller skate having a shoe structure and a unitary sole plate. The sole plate has a bottom surface and an upper surface adapated to receive the shoe structure and defines a heel portion, a toe portion and an instep portion therebetween. The roller skate further includes a pair of truck assemblies secured to the bottom surface of the sole plate at the toe portion and the heel portion by fastener means including a threaded rod and a correspondingly threaded fastener. The sole platet has an aperture for receiving the threaded rod and a recess extending from the upper surface towards the bottom surface. The recess communicates with the aperture and is dimensioned for receiving and confining the threaded fastener therein beneath the shoe structure and to restrain the fastener against rotation. In accordance with a preferred embodiment, the upper surface of the sole plate heel portion is raised with respect to the toe portion so as to form a heel in the sole plate for the shoe structure.

7 Claims, 5 Drawing Figures

ROLLER SKATE WITH IMPROVED SOLE PLATE

BACKGROUND OF THE INVENTION

The present invention relates generally to roller skates and more particularly to an improved roller skate sole plate of low cost, light weight, and great durability.

Rink type roller skates are conventionally provided with a shoe structure secured to a sole plate. From the bottom surface of the sole plate, front and rear roller trucks depend. The trucks are secured to the sole plate by a threaded member which is received by a correspondingly threaded bore in the sole plate. Also, the trucks generally include one or more cushion members received by the threaded member and held thereon by a pair of nuts.

During use of such skates, the vibration subjected to the roller trucks can cause the cushion securing nuts to become loosened. Eventually, the bottom most nut may even fall off or the threaded member itself may become totally unthreaded from the sole plate. Obviously, neither condition is desirable.

Prior art sole plates have also had a relatively flat upper surface. This required a separate heel to be formed in the shoe structure.

It is therefore a general object of the present invention to provide a new and improved roller skate.

It is a more particular object of the present invention to provide a sole plate for a roller skate which prevents loosening of the truck rollers thereon.

It is a still further object of the present invention to provide a sole plate for a roller skate which is unitary in structure and includes an integrally formed heel thus negating the need for a separately formed heel member for the shoe structure.

It is a still further object of the present invention to provide a sole plate for a roller skate which is unitary in structure and which may be formed from high impact plastic to thereby render the sole plate light in weight, low in cost, and great in durability.

SUMMARY OF THE INVENTION

The present invention therefore provides a roller skate comprising a shoe structure, a unitary sole plate having an upper surface adapted to receive the shoe structure and a bottom surface, a truck assembly, and fastener means including a threaded rod and a correspondingly threaded fastener for mounting the truck assembly to the sole plate bottom surface. The sole plate has an aperture for receiving the threaded member and a recess extending from the upper surface towards the bottom surface. The recess communicates with the aperture and is dimensioned for receiving and confining the threaded fastener therein beneath the shoe structure and to restrain the fastener against rotation.

The sole plate of the roller skate further includes a heel portion and a toe portion. The heel portion is raised with respect to the toe portion so as to form a heel in the sole plate for the shoe structure.

BRIEF DESCRIPTION OF THE DRAWINGS

The features of the present invention which are believed to be novel are set forth with particularity in the appended claims. The organization and manner of operation of the invention, together with further objects and advantages thereof, may be best understood by making reference to the following description taken in conjunction with the accompanying drawings, in the several figures of which like reference numerals identify identical elements, and wherein:

DESCRIPTION OF THE PREFERRED EMBODIMENT

Figures 1, 2, 3, 4, 5:
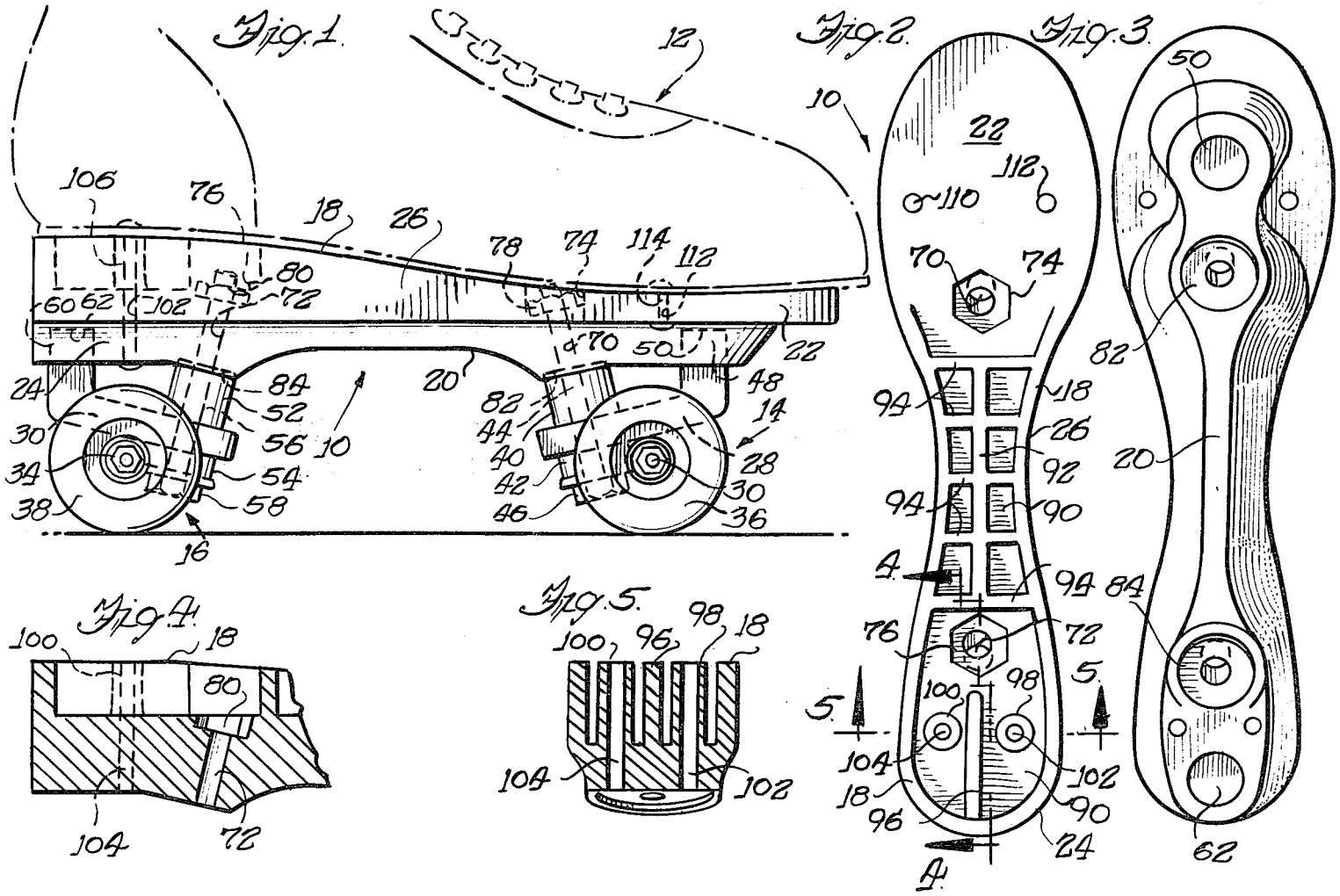
FIG. 1 is a side elevational view of a roller skate embodying the present invention.
FIG. 2 is a top plan view of a sole plate embodying the present invention.
FIG. 3 is a bottom plan view of a sole plate of FIG. 2.
FIG. 4 is a partial cross sectional view taken along lines 4—4 of FIG. 2.
FIG. 5 is a cross sectional view taken along lines 5—5 of FIG. 2.

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Referring now to FIG. 1, the roller skate embodying the present invention there illustrated comprises a unitary sole plate 10, a shoe structure 12, and front and rear roller trucks 14 and 16 respectively. The sole plate 10 includes an upper surface 18 to which the shoe structure 12 is affixed and a bottom surface 20 from which the truck rollers 14 and 16 depend. The sole plate further defines a toe portion 22, a heel portion 24, and an instep portion 26 therebetween.

The truck rollers 14 and 16 each include a strut arm 28 and 30 which include an integrally formed truck housing arranged to support axles 32 and 34. The axles 32 and 34 further support wheels or rollers 36 and 38 which are mounted thereon for rotation.

On opposite sides of the rear end of the strut arm 28 there are disposed a pair of cushion members 40 and 42 which, along with the strut arm 28, receive an action screw or threaded rod member 44 which coacts with a self-locking nut 46 to securely hold the strut arm 28 and cushion members 40 and 42 in assembled relation between the bottom surface 20 of the sole plate 10 and the self-locking nut 46. The forward end of the strut arm 28 terminates in a nub 48 which is received by a socket 50 formed in the toe portion 22 of the sole plate 10.

Similarly, the truck assembly 16 includes a pair of cushion members 52 and 54 which are disposed on opposite sides of the strut arm 30 by another action screw or threaded rod member 56 and another self-locking nut 58 which holds the same in secured relation against the bottom surface 20 of the sole plate 10. The strut arm 30 terminates in a nub 60 which is received in a socket 62 at the heel portion of the skate.

In accordance with one aspect of the present invention, it will be noted in FIGS. 1 and 2 that the sole plate 10 includes a first aperture 70 for receiving the action screw 44 of truck assembly 14 and a second aperture 72 for receiving the action screw 56 of the truck assembly 16. The sole plate 10 further includes a first recess 74 and a second recess 76 which extend from the top surface 18 of the sole plate 10 towards the bottom surface 20 to communicate with the first and second apertures 70 and 72 respectively. The recesses 74 and 76 are dimensioned to receive threaded fasteners or nuts 78 and 80 respectively. The threaded fasteners 78 and 80 have an outer dimension corresponding to a hexagon and the recesses 74 and 76 have a corresponding inner dimension defining a hexagon in transverse cross-section. The recesses 74 and 76 are further dimensioned to confine the threaded fasteners 78 and 80 against rotation. As a result, the truck assemblies 14 and 16 may be secured to the sole plate 10 prior to the affixing of the shoe structure 12 to the sole plate upper surface 18 by simply inserting the threaded fasteners or nuts 78 and 80 into their corresponding recesses 74 and 76 and thereafter threading the action screws 44 and 56 therein. With the nuts 78 and 80 and self-locking nuts 46 58 being tightly threaded onto the action screws 44 and 56, the truck assemblies are securely affixed to the sole plate 10. Because the recesses 74 and 76 are dimensioned to confine and restrain the nuts 78 and 80 against rotation, it is assured that the action screws 44 and 56 will remain tightly threaded thereto. Furthermore, after the shoe structure 12 is affixed to the upper surface 18 of the sole plate 10, the threaded fastener nuts 78 and 80 will be confined within the recesses between the sole plate 10 and the shoe structure 12.

To further assist in the assembly of the truck assemblies 14 and 16 to the sole plate, and in accordance with another aspect of the present invention, the sole plate 10 is provided with a socket recess 82 about aperture 70 dimensioned to receive the cushion member 40 and a socket recess 84 about aperture 72 dimensioned to receive the cushion member 52. By virtue of the socket recesses 82 and 84, the cushion members 40 and 52 are positively positioned between the sole plate 10 and the strut arms 28 and 30.

Referring now to FIG. 3, in accordance with another aspect of the present invention, it will be noted that the sole plate 10 is hollowed out in the instep portion 26 and heel portion 24 to define a bottom wall 90 of the sole plate 10. Within the instep portion 26 there are provided a plurality of support ribs so as to render the sole plate light in weight but yet strong and durable in construction. The support ribs include a longitudinal rib 92 and a plurality of transverse ribs 94 which extend from the bottom wall 90 upwardly to the upper surface 18 of the sole plate. To provide support for the shoe structure 12 in the heel portion 24, the sole plate further includes a centrally disposed support rib 96 which also extends from the bottom wall 90 upwardly to the upper surface 18 of the sole plate. The rib 96 also extends from the sole plate heel end towards the instep portion 26 between a pair of columns 98 and 100.

As may be best seen in FIG. 5, the columns 98 and 100 each include a bore 102 and 104 respectively. The bores 102 and 104 accommodate an elongated rivet 106 (FIG. 1) or other suitable securing means for securing the shoe structure 12 to the sole plate 10 in the heel portion 24. As a result, the columns 98 and 100 and support rib 96 lend support to the heel portion of the skate while providing a means by which the shoe structure 12 may be securely assembled to the sole plate 10.

For securing the toe end of the shoe structure 12 to the sole plate 10, the sole plate 10 further includes a pair of bores 110 and 112 in the toe portion 22 thereof. The bores 110 and 112 extend through the sole plate and accommodate another pair of rivets 114 for securing the toe end of the shoe structure 12 to the sole plate 10.

Lastly, and in accordance with a further aspect of the present invention, it will be noted in FIG. 1 that the upper surface 18 of the sole plate 10 is raised in the heel portion 24 with respect to the toe portion 22. The heel portion 24 and toe portion 22 are smoothly joined together by the instep portion 26. As a result of this construction, a heel for the shoe structure 12 is formed within the sole plate itself thus negating the need for a separately formed heel for the shoe structure 12.

Preferably, the sole plate 10 is formed from a high impact, light weight, and strong plastic material such as polypropylene in a blow-molding operation of the type well known in the art. However, the sole plate 10 may also be formed from metal such as aluminum or aluminum alloys commonly used in the roller skate art without departing from the present invention.

As a result of the foregoing, it can be appreciated that the present invention provides a new and improved roller skate and a new and improved sole plate therefor. By virtue of the recesses 74 and 76 which confine the threaded fasteners 78 and 80 against rotation within the sole plate 10, assembly of the roller skate is considerably simplified for securing the truck assemblies to the sole plate. Furthermore, the recesses along with the shoe structure 12 secured to the sole plate 10 confine the nuts 78 and 80 therein. By virtue of the socket recesses 82 and 84, the cushion members 40 and 52 are positively positioned against the bottom surface 20 of the sole plate 10 when the truck assemblies 14 and 16 are secured to the sole plate. Furthermore, because the heel portion 24 is raised with respect to the toe portion 22, a heel for the roller skate is integrally formed in the sole plate and thus renders a separately formed heel for the shoe structure 12 unnecessary. Lastly, because the sole plate is hollowed out in the instep and heel portions and provided with the support ribs as described, a light weight yet highly durable sole plate is provided.

While a particular embodiment of the invention has been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A sole plate for a roller skate of the type including a truck assembly secured to the sole plate by a threaded fastener assembly, said sole plate comprising a unitary structure formed of plastic and having an upper surface and a bottom surface, said upper surface being adapted to be secured to a shoe structure, and including a heel portion, a toe portion, and an instep portion smoothly joining said toe portion with said heel portion, said heel portion being raised with respect to said toe portion so as to form a heel in said sole plate for the shoe structure, said instep portion and said heel portion being hollowed out to define a bottom wall, said instep portion including at least one longitudinal support rib and a plurality of transverse support ribs, and said heel portion including a centrally disposed support rib extending from the sole plate heel end towards said instep portion, said ribs extending from said bottom wall toward said sole plate upper surface, a pair of columns disposed on opposite sides of said heel portion support rib and extending from said bottom wall toward said upper surface within said heel portion, each of said columns including a through bore extending downwardly to said sole plate bottom surface to accommodate securing means for securing the shoe structure to said sole plate in said heel portion, an aperture in said heel portion for receiving a portion of the threaded fastener assembly therethrough, and a recess extending from said bottom wall towards said bottom surface, said recess communicating with said aperture and being dimensioned for receiving and confining an end portion of the threaded fastener assembly therein to restrain said end portion against rotation.

2. A sole plate as defined in claim 1 wherein said recess is hexagonal in transverse cross-sectional dimension.

3. A sole plate as defined in claim 1 further comprising a socket recess within said bottom surface about said aperture for receiving and positively positioning a cushion member between the sole plate and a support member of the truck assembly.

4. A sole plate for a roller skate comprising: a unitary structure formed of plastic and having an upper surface, and a bottom surface and defining a toe portion, a heel portion, and an instep portion therebetween, said upper surface being adapted to securely receive a shoe structure, and said upper surface being raised at said heel portion with respect to said toe portion to form a heel in said sole plate for the shoe structure, said heel portion being hollowed out to define a bottom wall and including a centrally disposed support rib extending from said bottom wall toward said sole plate upper surface and a pair of columns disposed one to either side of said support rib and extending from said bottom wall toward said sole plate top surface, each of said columns including a through bore extending downwardly to said sole plate bottom to accommodate securing means for securing said shoe structure to said sole plate heel portion.

5. A roller skate comprising: a shoe structure; a unitary sole plate formed of plastic and having an upper surface adapted to receive said shoe structure and a bottom surface; a pair of truck assemblies, and threaded fastener means for mounting each of said truck assemblies to said sole plate bottom surface; said sole plate having an aperture for receiving each threaded fastener means and a pair of recesses extending from said upper surface towards said bottom surface, each said recess communicating with one of said apertures and dimensioned for receiving and confining an end portion of one of said threaded fastener means therein beneath said shoe structure and to restrain said threaded fastener means against rotation; wherein said sole plate includes a heel portion, a toe portion and an instep portion smoothly joining said toe portion with said heel portion, and said heel portion is raised with respect to said toe portion so as to form a heel in said sole plate for said shoe structure; wherein said instep portion and said heel portion are hollowed out and define a bottom wall, and said instep portion includes at least one longitudinal support rib and a plurality of transverse support ribs, and said heel portion includes a centrally disposed support rib extending from the sole plate heel end towards said instep portion; wherein said support ribs extend from said bottom wall toward said sole plate upper surface; and wherein said sole plate further includes a pair of columns extending from said bottom wall toward said upper surface within said heel portion and each of said columns includes a through bore extending downwardly to said sole plate bottom surface to accommodate securing means for securing said shoe structure to said sole plate heel portion.

6. A roller skate as defined in claim 5 wherein said columns are disposed on opposite sides of said heel portion support rib.

7. A roller skate comprising: a shoe structure; a unitary plastic sole plate having a bottom surface and an upper surface adapted to receive said shoe structure, said sole plate defining a toe portion, a heel portion, and an instep portion therebetween; and a truck assembly secured to said sole plate bottom surface at said heel portion and at said toe portion, said upper surface of said sole plate heel portion being raised with respect to said toe portion so as to form a heel in said sole plate for said shoe structure, said heel portion being hollowed out to define a bottom wall and including a centrally disposed support rib extending from said bottom wall toward said sole plate upper surface and a pair of columns disposed one to either side of said support rib and extending from said bottom wall toward said sole plate top surface, each of said columns including a through bore extending downwardly to said sole plate bottom to accommodate securing means for securing said shoe structure to said sole plate heel portion.

* * * * *